United States Patent [19]

Ellis

[11] Patent Number: 5,067,212

[45] Date of Patent: Nov. 26, 1991

[54] SEAT BELT BUCKLE

[75] Inventor: Robert P. Ellis, Rochester, Mich.

[73] Assignee: TRW Vehicle Safety Systems Inc., Lyndhurst, Ohio

[21] Appl. No.: 573,877

[22] Filed: Aug. 27, 1990

[51] Int. Cl.[5] ..... A44B 11/25

[52] U.S. Cl. ..... 24/642; 24/633; 24/641

[58] Field of Search ..... 24/642, 641, 633, 639, 24/652

[56] References Cited

U.S. PATENT DOCUMENTS 4,065,836 1/1978 Stephenson ..... 24/642
4,096,606 6/1978 Stephenson ..... 24/641
4,550,474 11/1985 Doty et al. .
4,562,625 1/1986 Doty et al. .
4,621,394 11/1986 Wier .
4,622,727 11/1986 Wier .
4,916,780 4/1990 Ballet .

FOREIGN PATENT DOCUMENTS 2202896 10/1988 United Kingdom ..... 24/633

*Primary Examiner*—Victor N. Sakran
*Attorney, Agent, or Firm*—Tarolli, Sundheim & Covell

[57] ABSTRACT

A seat belt buckle has a spring biased ejector member and a slidable pushbutton member. A coil spring biases both the pushbutton member and the ejector member. A secure connection between the ejector member and the pushbutton member is provided in a vertically compact structure. Contact surfaces on the ejector member and contact surfaces on the pushbutton member are all contained vertically within the confines of a track along which those members slide horizontally in the buckle.

20 Claims, 6 Drawing Sheets

SEAT BELT BUCKLE

FIELD OF THE INVENTION

The present invention relates to a seat belt buckle, and particularly relates to a seat belt buckle having a spring biased ejector member.

BACKGROUND OF THE INVENTION

U.S. Pat. No. 4,622,727 discloses a seat belt buckle having a spring biased ejector member. The buckle further comprises a base, a pushbutton member, and a lock bar. The lock bar is supported for vertical movement into and out of a position in which it extends across a horizontal track within the base. The ejector member is supported from horizontal movement along the track, and is spring biased into a position in which it blocks entry of the lock bar into the track. When a seat belt locking tongue is inserted into the buckle, the leading edge of the locking tongue engages the ejector member. The locking tongue slides the ejector member along the track against the bias of a coil spring. When the locking tongue is fully inserted into the buckle, the ejector member is moved out of the path of movement of the lock bar so that the lock bar can move vertically into the track under the influence of a leaf spring. When extending across the track, the lock bar engages the locking tongue to hold the locking tongue in the buckle. When the locking tongue is to be released from the buckle, the vehicle occupant pushes the pushbutton member to slide it along the base toward an unlocking position. Cam surfaces on the pushbutton member then lift the lock bar out of the track and out of engagement with the locking tongue. The ejector member then slides along the track against the leading edge of the locking tongue under the influence of the coil spring and ejects the locking tongue from the buckle.

In the '727 buckle, the pushbutton member is connected to the coil spring through the ejector member. The coil spring thereby resists sliding movement of the pushbutton member toward the unlocking position, and can move the pushbutton member back from the unlocking position to its original position. For this purpose, the pushbutton member includes an elongated narrow plastic piece extending from the center of the pushbutton member. The plastic piece has a free end in abutting contact with the free end of a narrow plastic piece which extends from the center of the ejector member. The narrow plastic pieces can experience shrinkage during molding. As a result, the pieces may be misaligned when assembled together. If misaligned, the pieces could deflect relative to each other and become wedged together. The pushbutton member and the ejector member would thus be wedged together, and the buckle would be inoperative.

SUMMARY OF THE INVENTION

In accordance with the present invention, a buckle for a seat belt locking tongue comprises a pushbutton member, a pair of guide surfaces, and an ejector member. The pushbutton member is supported for movement along an axis. The guide surfaces are spaced apart a distance approximately equal to the thickness of the seat belt locking tongue to define a track along which the tongue can move into and out of the buckle along the axis. The ejector member has an ejector surface for engaging the tongue, and a pair of contact surfaces for engaging the pushbutton member. The contact surfaces are located on opposite sides of the axis. The ejector member is supported for movement along the axis with the contact surfaces contained in the track between the guide surfaces.

In accordance with another feature of the present invention, an ejector member for a seat belt buckle has a body portion and a pair of tabs projecting horizontally from the body portion. The body portion has an ejector surface for engaging a seat belt locking tongue, and the tabs each have a contact surface for engaging a pushbutton member in the buckle.

In accordance with yet another feature of the present invention, an ejector member for a seat belt buckle has an upper horizontal planar surface, and a lower horizontal planar surface spaced vertically from the upper horizontal planar surface a distance which is approximately equal to the thickness of a seat belt locking tongue to be inserted into the buckle. The ejector member has an ejector surface for engaging the tongue, and a contact surface for engaging a pushbutton member in the buckle. The contact surface is located entirely between the upper and lower horizontal planar surfaces of the ejector member.

In a preferred embodiment of the present invention, the pushbutton member has a second pair of contact surfaces for engaging the first pair of contact surfaces on the ejector member. The first pair of contact surfaces on the ejector member and the second pair of contact surfaces on the pushbutton member all have positions contained in the track between the inner surfaces which define the track.

A seat belt buckle in accordance with the present invention advantageously provides secure contacts between the ejector member and the pushbutton member so that the spring which biases the ejector member also biases the pushbutton member. The contact surfaces cannot become misaligned because they are held in place between the walls of the track in which they slide. A seat belt buckle in accordance with the present invention also provides the additional advantage of a compact and slender structure, because the contact surfaces do not extend vertically beyond the thickness of the tongue to any substantial degree.

BRIEF DESCRIPTION OF THE DRAWINGS

These and other features of the present invention will become apparent to those of ordinary skill in the art to which the invention relates upon reading the following description of a preferred embodiment of the invention in view of the accompanying drawings wherein.

DESCRIPTION OF A PREFERRED EMBODIMENT

Figure 1:
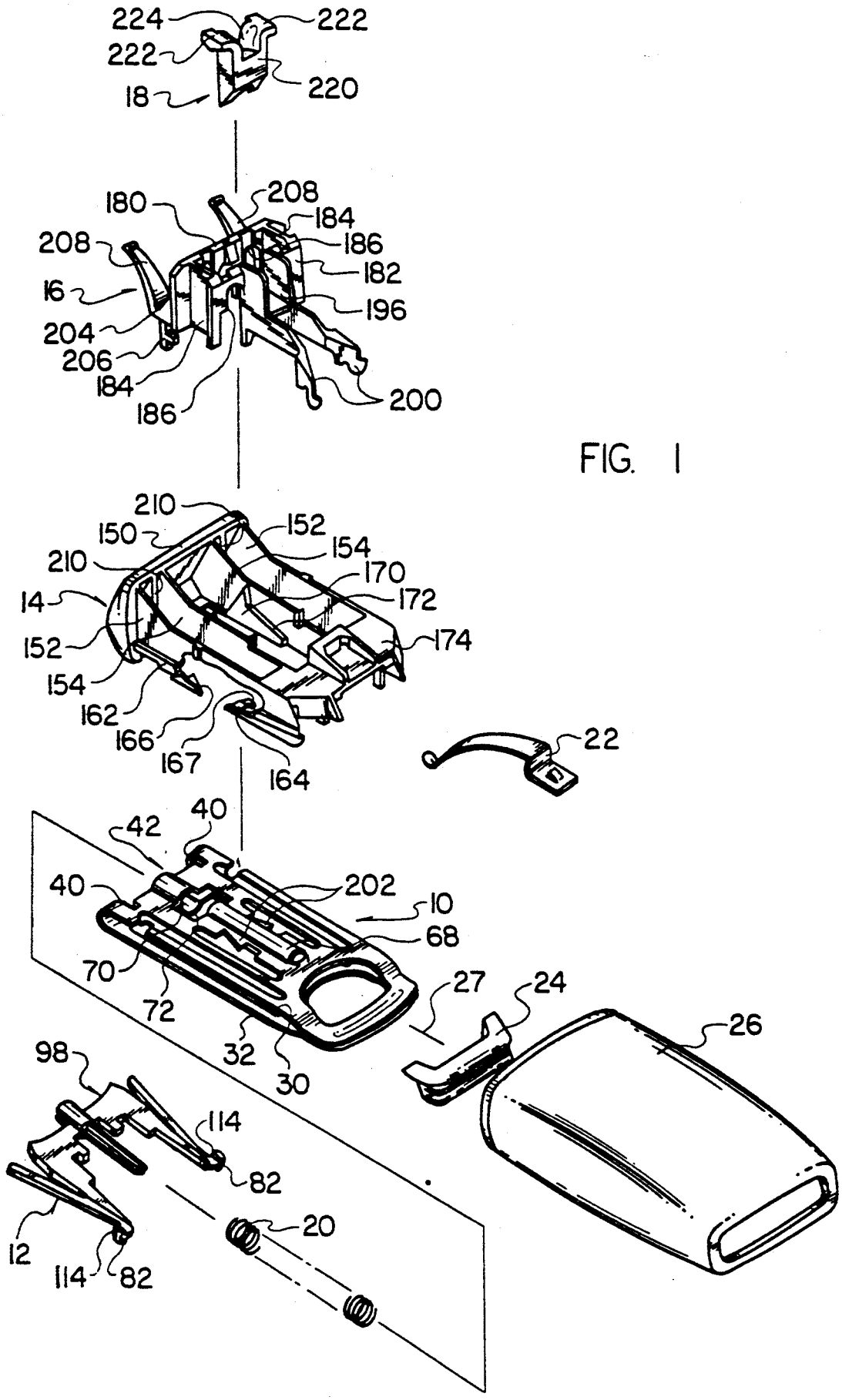
FIG. 1 is an exploded perspective view of a seat belt buckle in accordance with a preferred embodiment of the present invention.
Figure 2A:
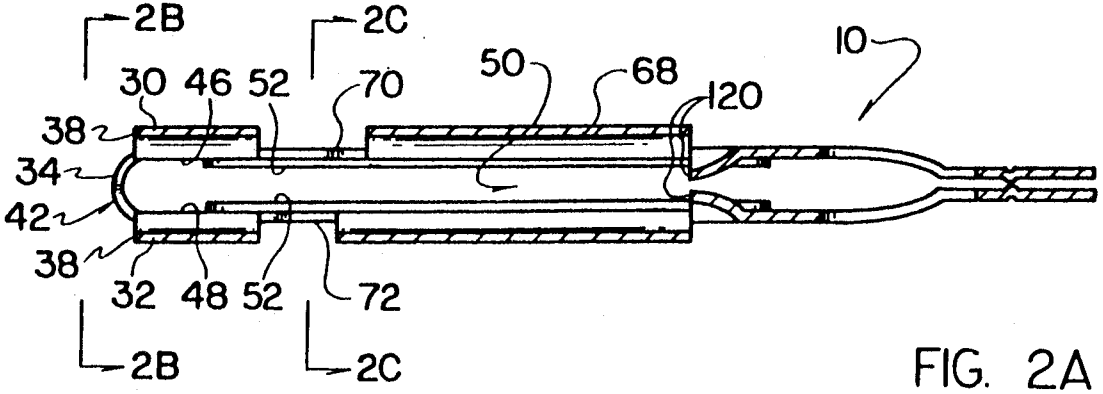
FIG. 2A is a sectional view of a component of the seat belt buckle of FIG. 1.
Figure 2C:
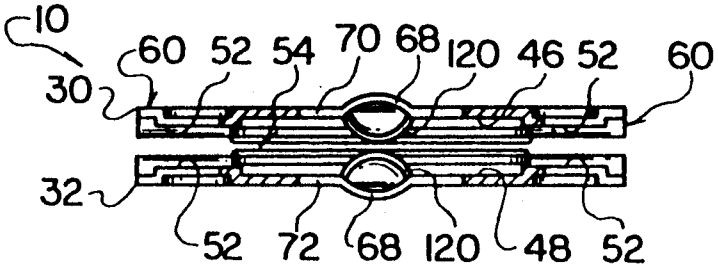
FIG. 2C is a sectional view taken on line 2C—2C of FIG. 2A.
Figure 2B:
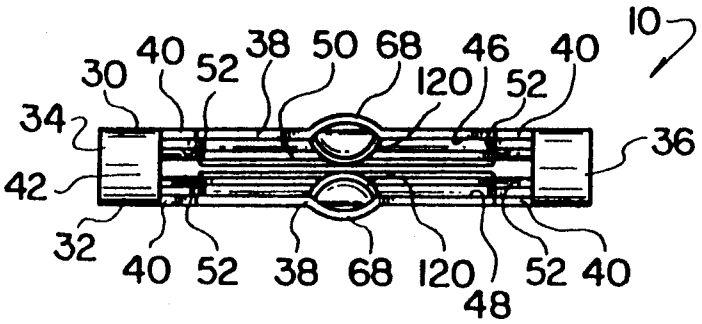
FIG. 2B is a sectional view taken on line 2B—2B of FIG. 2A.

As shown in FIG. 1, a seat belt buckle in accordance with a preferred embodiment of the present invention comprises a base 10, an ejector 12, and a pushbutton member 14. The seat belt buckle further comprises a lock bar guide 16 and a lock bar 18, a coil spring 20, a leaf spring 22, and a clamp 24. A housing 26 contains the other components of the seat belt buckle in positions centered on an axis 27 when the buckle is assembled.

As shown in FIGS. 1 and 2A through 2C, the base 10 is formed of an elongated metal piece which is folded to define an upper wall 30 and a lower wall 32. The clamp 24 is receivable on the rear ends of the upper and lower walls 30 and 32 of the base 10 to hold them firmly together. The base 10 has a pair of spaced-apart, curved front end surfaces 34 and 36 that join the upper and lower walls 30 and 32. Between the front end surfaces 34 and 36, each of the upper and lower walls 30 and 32 of the base 10 has a front edge surface 38. Each front edge surface 38 defines a pair of spaced apart notches 40 adjacent to the curved front end surfaces 34 and 36. The front edge surfaces 38 and the curved front end surfaces 34 and 36 define a generally rectangular opening 42 at the front end of the base 10. The opening 42 has a horizontal length approximately equal to the width of a seat belt locking tongue 45 (FIG. 5), and has a vertical width approximately equal to the thickness of the locking tongue 45.

The upper and lower walls 30 and 32 of the base 10 also have inner surfaces 46 and 48, respectively. The inner surfaces 46 and 48 are spaced apart to define a generally rectangular horizontal track 50 in the base 10 which extends inwardly from the opening 42. Each of the inner surfaces 46 and 48 includes a ridge portion 52 adjacent to each lateral side of the base 10. The ridge portions 52 of the inner surfaces 46 and 48 define a central region 54 of the track 50, and define outer edge regions 60 of the track 50 on opposite lateral sides of the central region 54. Each of the upper and lower walls 30 and 32 of the base 10 further comprises a semi-cylindrical central portion 68. Cut-out surfaces 70 and 72 that extend through the central portions 68 define a passage extending vertically through the base 10.

Figure 3A:
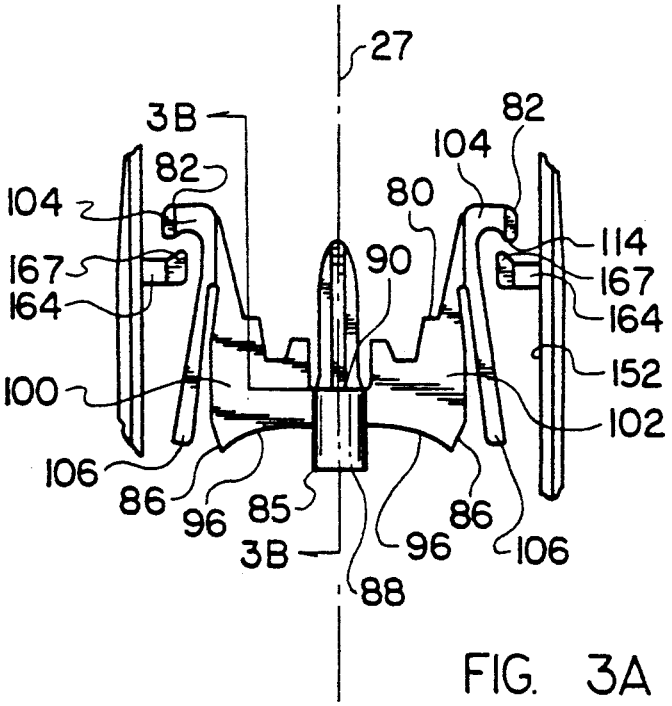
FIG. 3A is a top view of components of the seat belt buckle of FIG. 1.
Figure 3B:
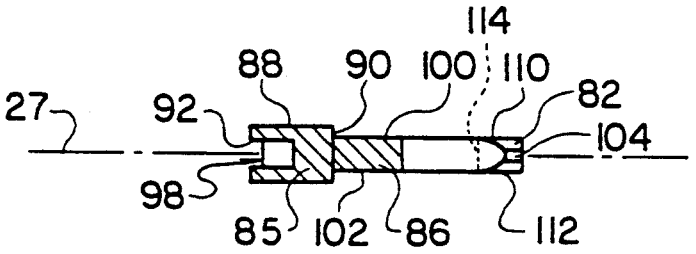
FIG. 3B is sectional view taken on line 3B—3B of FIG. 3A.

As shown in FIGS. 1, 3A and 3B, the ejector 12 comprises a body 80 and a pair of horizontally projecting tabs 82. The body 80 of the ejector 12 includes a shaft 84, a cylindrical forward end portion 85, and a pair of wing-like portions 86 projecting diametrically from the forward end portion 85. The forward end portion 85 has a radially outer circumferential surface 88, an annular radially extending rear surface 90, and an inner surface 92 which defines a slot extending inwardly from the forward end of the portion 85 along the axis 27. The wing-like portions 86 have forward edge surfaces 96 which define an ejector surface 98 extending transversely across the axis 27. Each of the wing-like portions 86 also has an upper horizontal planar surface 100 and a lower horizontal planar surface 102. The lower horizontal planar surface 102 is spaced vertically from the upper horizontal planar surface 100 a distance which is approximately equal to the thickness of the seat belt locking tongue 45.

Relatively narrow sections 104 of the body 80 support the tabs 82 at the rear end of the ejector 12. The narrow sections 104 include fingers 106 that project toward the forward end of the ejector 12, and are spaced from the wing-like portions 86. The tabs 82 have upper and lower horizontal planar surfaces 110 and 112 which lie in the planes of the upper and lower horizontal planar surfaces 100 and 102 on the body portion 80, respectively. The upper and lower horizontal planar surfaces 110 and 112 on the tabs 82 are thus spaced apart a distance which is approximately equal to the thickness of the seat belt locking tongue 45. The tabs 82 also have contact surfaces 114 which extend vertically between the upper and lower horizontal planar surfaces 110 and 112, and which are spaced horizontally from the ejector surface 98 in a direction transverse to the axis 27.

Figure 4:
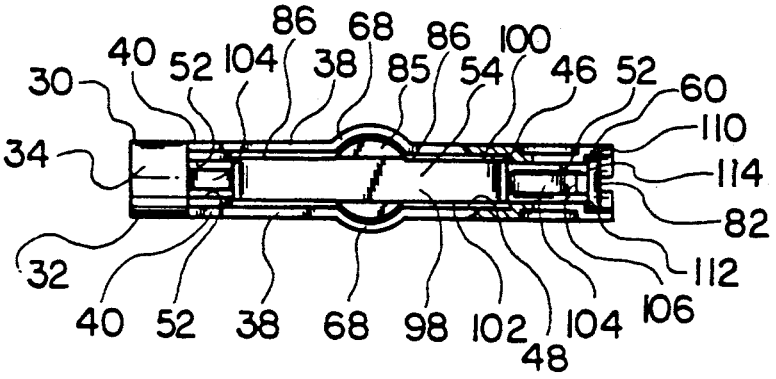
FIG. 4 is a front view of components of the seat belt buckle of FIG. 1.
Figure 5:
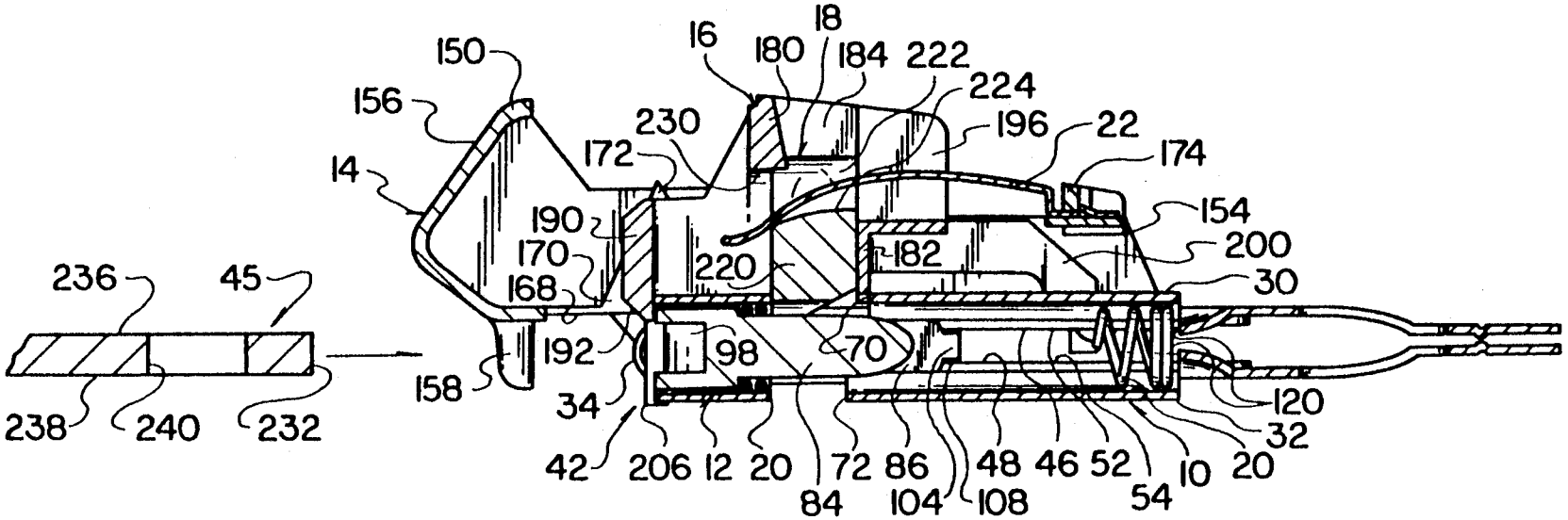
FIGS. 5 through 7 are partial sectional views of the seat belt buckle of FIG. 1, showing parts in shifted positions.
Figure 6:
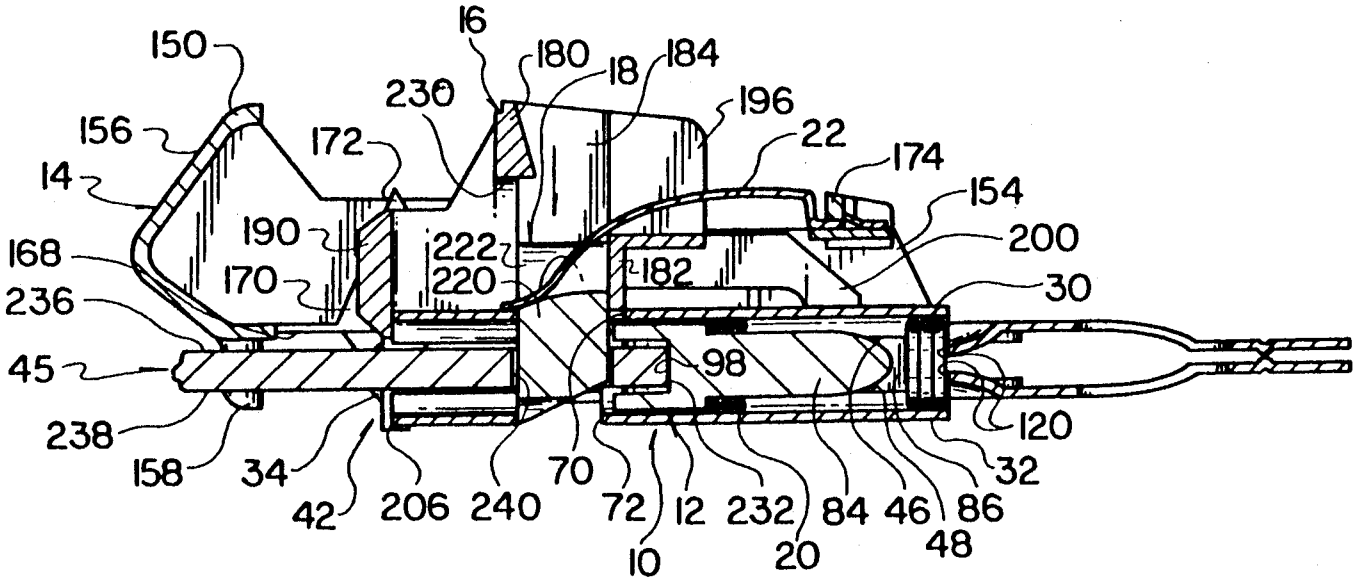
Figure 7:
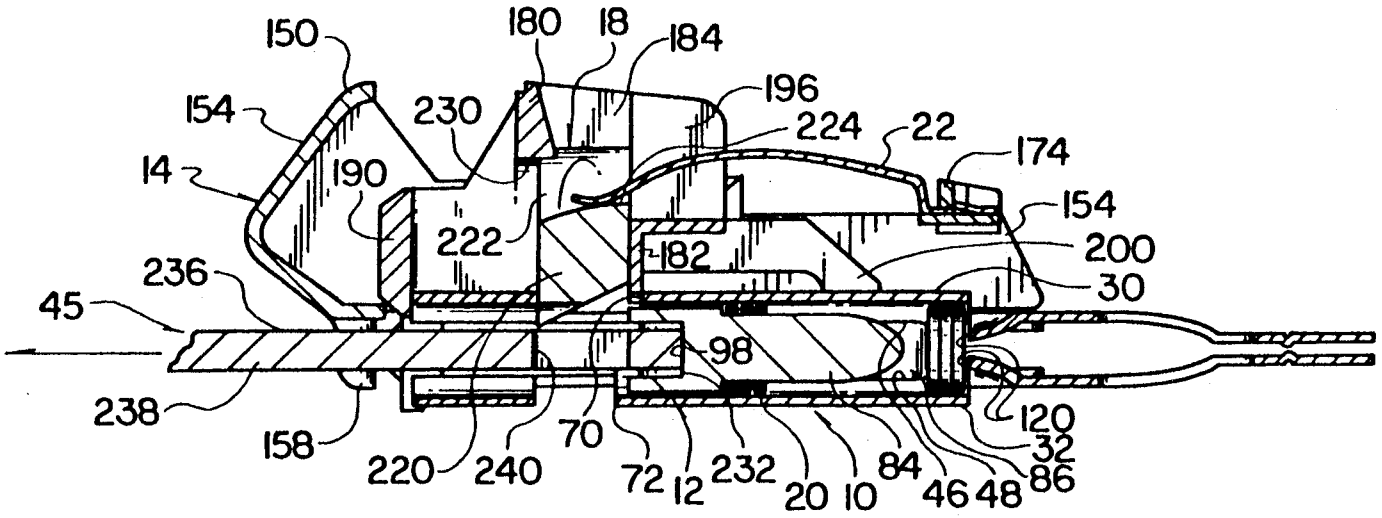

As indicated in FIGS. 1 and 4, the ejector 12 and the coil spring 20 are receivable in the opening 42 at the front end of the base 10 to take the positions shown in FIGS. 5 through 7. The coil spring 20 is received coaxially over the shaft 84 on the ejector 12, and fits between the semi-cylindrical portions 68 of the upper and lower walls 30 and 32 of the base 10. One axial end of the coil spring 20 rests against the annular rear surface 90 of the forward end portion 85 of the ejector 12. The other axial end of the coil spring 20 rests against stop surfaces 120 (FIG. 2A) defined by indented portions of the upper and lower walls 30 and 32 of the base 10. The fingers 106 on the ejector 12 are resiliently flexible in directions transverse to the axis 27 in order to permit passage of the ejector 12 inwardly through the opening 42, and to block passage of the ejector 12 outwardly through the opening 42.

As shown in FIG. 4, the ejector 12 is received in the track 50 with the tabs 82 in the outer edge regions 60 of the track 50. The narrow sections 104 of the ejector 12 are received in the track 50 between the ridge portions 52 of the inner surfaces 46 and 48. The wing-like portions 86, the forward end portion 85, and the shaft 84 are received in the central region 54 of the track 50. The upper surfaces 100 and 110 on the ejector 12 slide against the inner surface 46 of the upper wall 30 of the base 12. The lower surfaces 102 and 112 slide against the inner surface 48 of the lower wall 38 of the base 12. The ejector 12 is thus guided for axial sliding movement in the track 50 between the position shown in FIG. 5 and the position shown in FIGS. 6 and 7.

The pushbutton member 14 comprises a front wall 150, two outer walls 152, and two inner walls 154. The front wall 150 has an upper surface 156 (FIG. 5) and a lower surface 158. The lower surface 158 defines an opening for horizontal movement of the seat belt locking tongue 45 beneath the upper surface 156 as indicated in FIG. 5. Each of the outer walls 152 of the pushbutton member 14 supports an outwardly extending edge 162 which engages the housing 26. Each of the outer walls 152 also supports an inwardly extending tab 164 and an inwardly extending guide piece 166. The tabs 164 have vertically extending contact surfaces 167. Each of the inner walls 154 of the pushbutton member 114 has a bottom surface 168 (FIG. 5), and each supports a cam structure 170 having an inclined surface 172, as best shown in FIG. 1. A rear bridging portion 174 of the pushbutton member 14 rigidly connects the outer walls 152 and the inner walls 154. The rear bridging portion 174 supports the leaf spring 22 as shown in FIGS. 5–7.

The pushbutton member 14 has an assembled position with the bottom surfaces 168 of the inner walls 154 atop the upper wall 30 of the base 10, and with the tabs 164 and the guide pieces 166 extending into the outer edge regions 60 of the track 50. The pushbutton member 14 is thus supported on the base 10 for axial sliding movement relative to the base 10 between the position shown in FIGS. 5 and 6 and the position shown in FIG. 7.

The lock bar guide 16 has a front wall 180, a rear wall 182, and a pair of opposite side walls 184. The front and rear walls 180 and 182 of the lock bar guide 16 have surfaces 186 which define arch-shaped openings through the front and rear walls 180 and 182. A generally cylindrical projection 190 at the forward side of the front wall 180 has an inclined tongue guide surface 192 (FIG. 5). A surface 196 defines an upwardly open three-sided rectangular passage extending centrally through the rear wall 182. Mounting legs 200 extend rearwardly from the rear wall 182, and have shapes adapted to snap into engagement with corresponding mounting surfaces 202 in the upper wall 30 of the base 10. A pair of triangular walls 204 project forwardly from the front wall 180. Each triangular wall 204 supports a downwardly projecting mounting tab 206 and an upwardly projecting resiliently flexible spring member 208.

The lock bar guide 16 has a stationary assembled position mounted on the base 10 as shown in FIGS. 5–7. When in its assembled position, the lock bar guide 16 has the mounting legs 200 engaged with the mounting surfaces 202 at the top of the base 10, and has the mounting tabs 206 engaged in the notches 40 at the front of the base 10. The tongue guide surface 192 takes a position adjacent to the opening 42 at the front of the base 10.

When the lock bar guide 16 and the pushbutton member 14 are both in their assembled positions, the inner walls 154 of the pushbutton member 14 extend axially through the arch-shaped openings defined by the surfaces 186 on the lock bar guide 16. The leaf spring 22 extends through the passage defined by the surface 196 on the lock bar guide 16. Also, vertical ribs 210 at the front wall 150 of the pushbutton member 14 engage the upper ends of the spring members 208. The pushbutton member 14 is thus slidable axially relative to both the lock bar guide 16 and the base 10 when in its assembled position. The spring members 208 on the lock bar guide 18 exert a biasing force urging the pushbutton member 14 axially forward toward the position shown in FIGS. 5 and 6.

The lock bar 18 has a body portion 220, a pair of flanges 222, and a surface 224 defining an upwardly open recess. The lock bar 18 is receivable in a passage which is defined between the front and rear walls 180 and 182 of the lock bar guide, and between the inner walls 154 of the pushbutton member 14. The lock bar 18 is movable vertically between the positions shown in FIGS. 5 and 6. The leaf spring 22 exerts a biasing force against the surface 224 of the lock bar 18 to urge the lock bar 18 vertically downward toward the position shown in FIG. 6. A stop surface 230 (FIG. 5) on the lock bar guide 16 limits upward vertical movement of the lock bar 18.

Operation of the seat belt buckle is illustrated in FIGS. 5–7. As shown in FIG. 5, the seat belt buckle has an open condition in which the ejector 12 is held by the coil spring 20 in a position adjacent to the front end of the track 50 in the base 10. The ejector 12 then blocks vertical movement of the lock bar 18 through the passage defined by the cut-out surfaces 70 and 72 in the base 10. The tongue 45 is movable into the main portion 54 of the track 50 through the opening 42 so that the leading surface 232 on the tongue 45 engages the ejector surface 98 on the ejector 12. The tongue 45 can be guided into the opening 42 by the tongue guide surface 192. The tongue 45 is further movable along the track 50 with the upper and lower surfaces 236 and 238 on the tongue 45 being guided in sliding contact with the inner surfaces 46 and 48 on the base 10. The tongue 45 thus moves the ejector 12 against the bias of the coil spring 20 until the tongue 45 and the ejector 12 take the positions shown in FIG. 6. The ejector 12 then does not block vertical movement of the lock bar 18 through the passage defined by the cut-out surfaces 70 and 72 in the base 10, and the lock bar 18 is moved into the position shown in FIG. 6 under the influence of the leaf spring 22. The lock bar 18 then extends through the track 50 and through an aperture 240 in the tongue 45 to lock the tongue 45 in the buckle.

When the tongue 45 is to be released from the buckle, the vehicle occupant manually exerts pressure against the upper surface 156 on the front wall 150 of the pushbutton member 14 to slide the pushbutton member 14 rearwardly relative to the base 10 from the position shown in FIGS. 5 and 6 to the position shown in FIG. 7. When the pushbutton member 14 moves toward the position shown in FIG. 7, the inclined surfaces 172 on the cam structures 170, which are supported on the inner walls 154 of the pushbutton member 14, move against the flanges 222 on the lock bar 18 to lift the lock bar 18 vertically upward. The lock bar 18 is thereby moved into the position shown in FIG. 7. When in the position shown in FIG. 7, the lock bar 18 does not extend through the aperture 240 in the tongue 45. The ejector 12 is then free to move the tongue 45 axially forward in the track 50 under the influence of the coil spring 20 to eject the tongue 45 from the buckle.

In accordance with the invention, a connection is provided between the pushbutton member 14 and the ejector 12 so that the coil spring 20 can bias both the pushbutton member 14 and the ejector 12 in the axially forward direction relative to the base 10. As shown in FIG. 3A, the contact surfaces 114 on the tabs 108 are aligned with the contact surfaces 167 on the tabs 164 to make a connection between the ejector 12 and the pushbutton member 14. The contact surfaces 167 move against the contact surfaces 114 to provide a connection for the coil spring 20 to resist movement of the pushbutton member 14 axially rearward from the position shown in FIG. 5. The contact surfaces 114 on the tabs 108 move against the contact surfaces 167 on the tabs 164 to provide a connection for the coil spring 20 to move both the ejector 12 and the pushbutton member 14 back from the positions shown in FIG. 7 toward the positions shown in FIG. 5. Importantly, the tabs 108 and the tabs 164 are guided within the outer edge regions 60 of the track 50. The contact surfaces 114 and 167 therefore can not become misaligned, and a secure connection is consistently provided for the coil spring 20 to bias the pushbutton member 14. Furthermore, the contact surfaces 114 and 167 do not extend vertically beyond the confines of the track 50, whereby a compact and slender structure is provided for the seat belt buckle.

The invention has been described with reference to a preferred embodiment. Improvements, changes and modifications will be apparent to those of ordinary skill in the art to which the invention pertains. Such improvements, changes and modifications are intended to be included within the scope of the appended claims.

Having described the invention, the following is claimed:

1. A buckle for a seat belt locking tongue, said buckle comprising:

a pushbutton member supported for movement along an axis; and an ejector member supported for movement along said axis, said ejector member having an ejector surface for engaging and moving the tongue, an upper horizontal surface, a lower horizontal surface spaced vertically from said upper horizontal surface a distance approximately equal to the thickness of the tongue, and a contact surface for engaging and moving said pushbutton member, said contact surface being located entirely between said upper and lower horizontal surfaces.

2. A buckle as defined in claim 1 wherein said ejector member comprises first and second contact surfaces for engaging and moving said pushbutton member, said first and second contact surfaces being located entirely between said upper and lower horizontal surfaces, said first and second contact surfaces being located on opposite sides of said axis.

3. A buckle as defined in claim 2 further comprising a spring in contact with said ejector member to bias said ejector member along said axis.

4. A buckle as defined in claim 3 wherein said contact surfaces are spaced horizontally apart from said ejector surface in a direction transverse to said axis.

5. A buckle as defined in claim 4 further comprising a base having a pair of inner surfaces, said inner surfaces having portions which are spaced apart a distance approximately equal to the thickness of the tongue, said inner surfaces defining a track along which the tongue can slide in said buckle along said axis, said inner surfaces extending laterally across said axis.

6. A buckle as defined in claim 5 wherein said first and second contact surfaces have positions contained in said track between said portions of said inner surfaces.

7. A buckle as defined in claim 6 wherein said pushbutton member has third and fourth contact surfaces for engaging said first and second contact surfaces on said ejector member, said third and fourth contact surfaces having positions contained in said track between said portions of said inner surfaces.

8. A buckle as defined in claim 7 wherein said pushbutton member has a pair of vertical outer side walls and a pair of tabs projecting inwardly from said side walls toward said axis, said third and fourth contact surfaces being formed on said tabs.

9. A buckle for a seat belt locking tongue, said buckle comprising:

a pushbutton member supported for movement along an axis;

a pair of guide surfaces having portions spaced apart a distance approximately equal to the thickness of the tongue, said guide surfaces defining a track along which the tongue can move into and out of said buckle along said axis;

an ejector member having an ejector surface for engaging and moving the tongue, and having a pair of contact surfaces for engaging and moving said pushbutton member, said contact surfaces being located on opposite sides of said axis and being spaced apart a distance in a direction perpendicular to said axis which is greater than the width of the tongue, said ejector member being supported for movement along said axis with said contact surfaces contained in said track between said portions of said guide surfaces;

said pushbutton member having a pair of contact surfaces for moving in contact with said contact surfaces on said ejector member, said contact surfaces on said pushbutton member having positions contained in said track between said guide surfaces; and said pushbutton member having a pair of outer side walls and a pair of tabs extending inwardly from said side walls toward said axis, said contact surfaces on said pushbutton member being formed on said tabs.

10. A buckle for a seat belt locking tongue, said buckle comprising:

a pushbutton member supported for movement along an axis;

a pair of guide surfaces having portions spaced apart a distance approximately equal to the thickness of the tongue, said guide surfaces defining a track along which the tongue can move into and out of said buckle along said axis, said guide surfaces having ridge portions extending in directions parallel to said axis, the ridge portions on one guide surface being spaced apart from the ridge portions on the other guide surface a distance less than the thickness of the tongue, said ridge portions defining a central region of said track extending laterally across said axis between said ridge portions, and defining outer edge regions of said track at positions laterally outward of said ridge portions; and an ejector member having an ejector surface for engaging and moving the tongue, and having a pair of contact surfaces for engaging and moving said pushbutton member, said contact surfaces being located on opposite sides of said axis, said ejector member being supported for movement along said axis with said contact surfaces contained in said track between said portions of said guide surfaces.

11. A buckle as defined in claim 10 wherein said contact surfaces on said ejector member are contained in said outer edge regions of said track.

12. A buckle as defined in claim 11 wherein said ejector member has a body portion including said ejector surface, a pair of tabs projecting horizontally from said body portion and each including one of said contact surfaces, and a pair of sections each contacting one of said tabs to said body portion, said ejector member being receivable in said track with said body portion in said central region of said track, said tabs in said outer edge regions of said track, and said sections between said spaced apart ridge portions of said guide surfaces.

13. A buckle for a seat belt locking tongue, said buckle comprising:

a pushbutton member supported for movement along an axis; and an ejector member supported for movement along said axis, said ejector member having a body portion and a pair of tabs projecting horizontally from said body portion in a direction transverse to said axis, said body portion having an ejector surface for engaging and moving the tongue, said tabs each having a contact surface for engaging and moving said pushbutton member, said contact surfaces being spaced apart from said ejector surface in said transverse direction;

said tabs each having an upper horizontal surface and a lower horizontal surface spaced apart from said upper horizontal surface a distance approximately equal to the thickness of the tongue, said contact surfaces being located entirely between said upper and lower horizontal surfaces.

14. A buckle as defined in claim 13 further comprising a base having a pair of spaced apart surfaces defining a track in which said ejector moves, said contact surfaces having positions contained in said track.

15. An ejector member for a seat belt buckle which releasably engages a seat belt locking tongue inserted into the buckle, and which has a slidable pushbutton member, said ejector member comprising:

a body portion having an axis and an ejector surface for engaging and moving the tongue, said ejector surface extending in a horizontal direction transverse to said axis;

a pair of tabs projecting horizontally from said body portion in said transverse direction, said tabs each having a contact surface for engaging and moving the pushbutton member, said contact surfaces being spaced from said ejector surface in said transverse direction; and said tabs each having an upper horizontal surface and a lower horizontal surface spaced vertically from said upper horizontal surface a distance approximately equal to the thickness of the tongue, said contact surfaces being located entirely between said upper and lower horizontal surfaces.

16. A buckle for a seat belt locking tongue, said buckle comprising:

a pushbutton member supported for movement along an axis;

a pair of guide surfaces having tongue guide portions spaced apart a distance approximately equal to the thickness of the tongue, said guide surfaces defining a track along which the tongue can move into and out of said buckle along said axis and between said tongue guide protons; and an ejector member having an ejector surface for engaging and moving the tongue, and having a pair of contact surfaces for engaging and moving said pushbutton member, said contact surfaces being located on opposite sides of said axis, said ejector member being supported for movement along said axis with said contact surfaces contained in said track between said guide surfaces.

17. A buckle as defined in claim 16 wherein said pushbutton member has a pair of contact surfaces for moving in contact with said contact surfaces on said ejector member, said contact surfaces on said pushbutton member being movable in said track between said guide surfaces.

18. A buckle as defined in claim 17 wherein said pushbutton member has a pair of outer side walls and a pair of tabs extending inwardly from said outer side walls toward said axis, said contact surfaces on said pushbutton member being formed on said tabs.

19. A buckle for a seat belt locking tongue, said buckle comprising:

a pushbutton member supported for movement along an axis;

an ejector member supported for movement along said axis, said ejector member having a body portion and a pair of tabs projecting horizontally from said body portion in a direction transverse to said axis, said body portion having an ejector surface for engaging and moving the tongue, said tabs each having a contact surface for engaging and moving said pushbutton member.

20. A buckle as defined in claim 14 wherein said contact surfaces are spaced apart from said ejector surface in said transverse direction.

* * * * *

UNITED STATES PATENT AND TRADEMARK OFFICE

CERTIFICATE OF CORRECTION

PATENT NO. : 5,067,212

DATED : November 26, 1991

INVENTOR(S) : Robert P. Ellis

It is certified that error appears in the above-identified patent and that said Letters Patent is hereby corrected as shown below:

Column 8, Line 47, Claim 12, delete "contacting" and insert --connecting--;

Line 56, Claim 13, delete "and"; and

Line 66, Claim 13, after "direction;" insert --and--.

Column 10, Line 2, Claim 16, delete "protons" and insert --portions--;

Line 9, Claim 16, delete "contained" and insert --located--;

Line 25, Claim 19, after "axis;" insert --and--; and

Line 34, Claim 20, change "14" to --19--.

Signed and Sealed this

Sixteenth Day of March, 1993

*Attest:*

STEPHEN G. KUNIN

*Attesting Officer*

*Acting Commissioner of Patents and Trademarks*